US009080447B2

(12) United States Patent
McMahan et al.

(10) Patent No.: US 9,080,447 B2
(45) Date of Patent: Jul. 14, 2015

(54) TRANSITION DUCT WITH DIVIDED UPSTREAM AND DOWNSTREAM PORTIONS

(71) Applicant: General Electric Company, Schenectady, NY (US)

(72) Inventors: Kevin Weston McMahan, Greer, SC (US); Jeffrey Scott LeBegue, Simpsonville, SC (US); Jaime Javier Maldonado, Simpsonville, SC (US); Daniel Jackson Dillard, Greenville, SC (US); James Scott Flanagan, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 98 days.

(21) Appl. No.: 13/848,204

(22) Filed: Mar. 21, 2013

(65) Prior Publication Data

US 2014/0283520 A1 Sep. 25, 2014

(51) Int. Cl.

| | |
|---|---|
| ***F01D 9/02*** | (2006.01) |
| ***F23R 3/00*** | (2006.01) |
| *F23R 3/42* | (2006.01) |

(52) U.S. Cl.

CPC ..... *F01D 9/023* (2013.01); *F23R 3/002* (2013.01); *F05D 2260/201* (2013.01); *F05D 2260/202* (2013.01); *F05D 2260/205* (2013.01); *F23R 3/425* (2013.01); *F23R 2900/03043* (2013.01); *F23R 2900/03044* (2013.01)

(58) Field of Classification Search

CPC ..... F01D 9/023; F23R 2900/03044; F23R 3/002; F23R 3/46; F23R 3/60; F23R 2900/00017; F23R 2900/03041–2900/03045; F23R 3/425; F02K 3/10; F02C 7/20; F05D 2260/201; F05D 2260/202; F05D 2260/205

USPC ..... 60/752, 755, 754, 756, 757, 39.37, 758, 60/796

See application file for complete search history.

(56) References Cited

U.S. PATENT DOCUMENTS

| | | | | |
|---|---|---|---|---|
| 4,422,288 | A | 12/1983 | Steber | |
| 5,077,967 | A | 1/1992 | Widener et al. | |
| 5,118,120 | A | 6/1992 | Drerup et al. | |
| 5,149,250 | A | 9/1992 | Plemmons et al. | |
| 5,249,920 | A | 10/1993 | Shepherd et al. | |
| 5,414,999 | A | 5/1995 | Barnes | |
| 5,457,954 | A | 10/1995 | Boyd et al. | |
| 5,592,820 | A | 1/1997 | Alary et al. | |
| 5,761,898 | A | 6/1998 | Barnes et al. | |
| 5,839,283 | A | 11/1998 | Dübbeling | |
| 5,933,699 | A * | 8/1999 | Ritter et al. | 419/6 |
| 5,934,687 | A | 8/1999 | Bagepalli et al. | |
| 6,076,835 | A | 6/2000 | Ress et al. | |
| 6,199,371 | B1 * | 3/2001 | Brewer et al. | 60/766 |
| 6,202,420 | B1 | 3/2001 | Zarzalis et al. | |

(Continued)

*Primary Examiner* — Phutthiwat Wongwian
*Assistant Examiner* — Alain Chau
(74) *Attorney, Agent, or Firm* — Dority & Manning, P.A.

(57) ABSTRACT

Turbine systems are provided. In one embodiment, a turbine system includes a transition duct comprising an inlet, an outlet, and a duct passage extending between the inlet and the outlet and defining a longitudinal axis, a radial axis, and a tangential axis. The outlet of the transition duct is offset from the inlet along the longitudinal axis and the tangential axis. The duct passage includes an upstream portion extending from the inlet and a downstream portion extending from the outlet. The turbine system further includes a rib extending from an outer surface of the duct passage, the rib dividing the upstream portion and the downstream portion.

20 Claims, 7 Drawing Sheets

(56) References Cited

U.S. PATENT DOCUMENTS

| | | | | |
|---|---|---|---|---|
| 6,203,025 | B1 | 3/2001 | Hayton | |
| 6,408,628 | B1 * | 6/2002 | Pidcock et al. | 60/752 |
| 6,431,555 | B1 | 8/2002 | Schroder et al. | |
| 6,431,825 | B1 | 8/2002 | McLean | |
| 6,442,946 | B1 | 9/2002 | Kraft et al. | |
| 6,471,475 | B1 | 10/2002 | Sasu et al. | |
| 6,537,023 | B1 | 3/2003 | Aksit et al. | |
| 6,564,555 | B2 | 5/2003 | Rice et al. | |
| 6,652,229 | B2 | 11/2003 | Lu | |
| 6,662,567 | B1 | 12/2003 | Jorgensen | |
| 7,007,480 | B2 | 3/2006 | Nguyen et al. | |
| 7,024,863 | B2 | 4/2006 | Morenko | |
| 7,181,914 | B2 | 2/2007 | Pidcock et al. | |
| 7,584,620 | B2 | 9/2009 | Weaver et al. | |
| 7,631,481 | B2 * | 12/2009 | Cowan et al. | 60/39.5 |
| 7,637,110 | B2 | 12/2009 | Czachor et al. | |
| 7,721,547 | B2 * | 5/2010 | Bancalari et al. | 60/752 |
| 8,322,146 | B2 | 12/2012 | Rizkalla et al. | |
| 2006/0130484 | A1 * | 6/2006 | Marcum et al. | 60/752 |
| 2010/0037617 | A1 | 2/2010 | Charron et al. | |
| 2010/0037618 | A1 | 2/2010 | Charron et al. | |
| 2010/0037619 | A1 | 2/2010 | Charron | |
| 2010/0115953 | A1 | 5/2010 | Davis, Jr. et al. | |
| 2010/0170259 | A1 * | 7/2010 | Huffman | 60/755 |
| 2010/0180605 | A1 | 7/2010 | Charron | |
| 2011/0259015 | A1 | 10/2011 | Johns et al. | |
| 2012/0186269 | A1 * | 7/2012 | Cihlar et al. | 60/796 |
| 2012/0304653 | A1 | 12/2012 | Flanagan et al. | |
| 2012/0304665 | A1 | 12/2012 | LeBegue et al. | |
| 2013/0167543 | A1 * | 7/2013 | McMahan et al. | 60/752 |

* cited by examiner

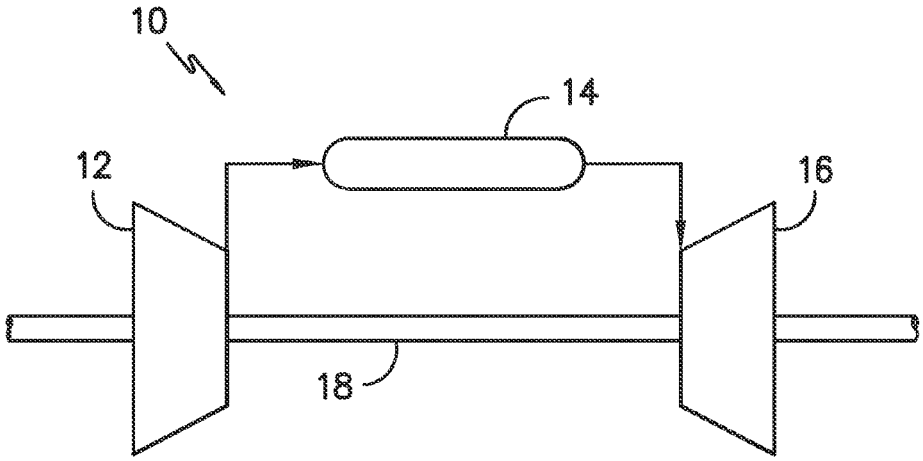
FIG. —1—
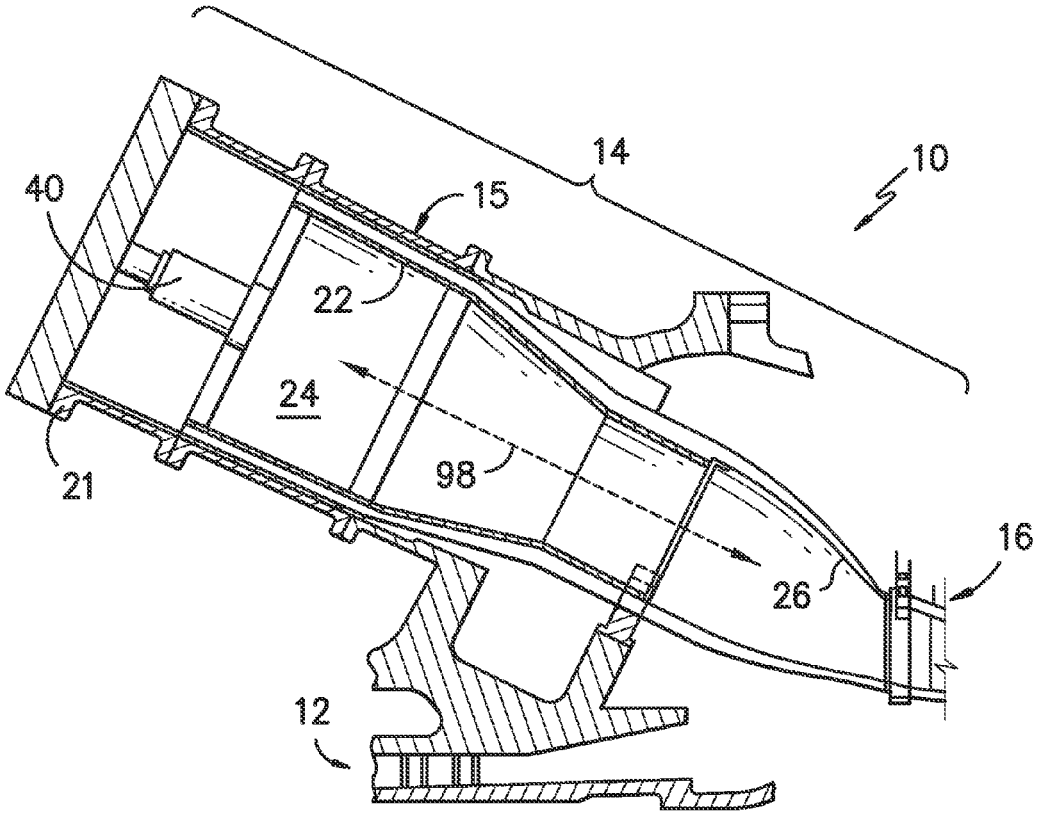
FIG. —2—

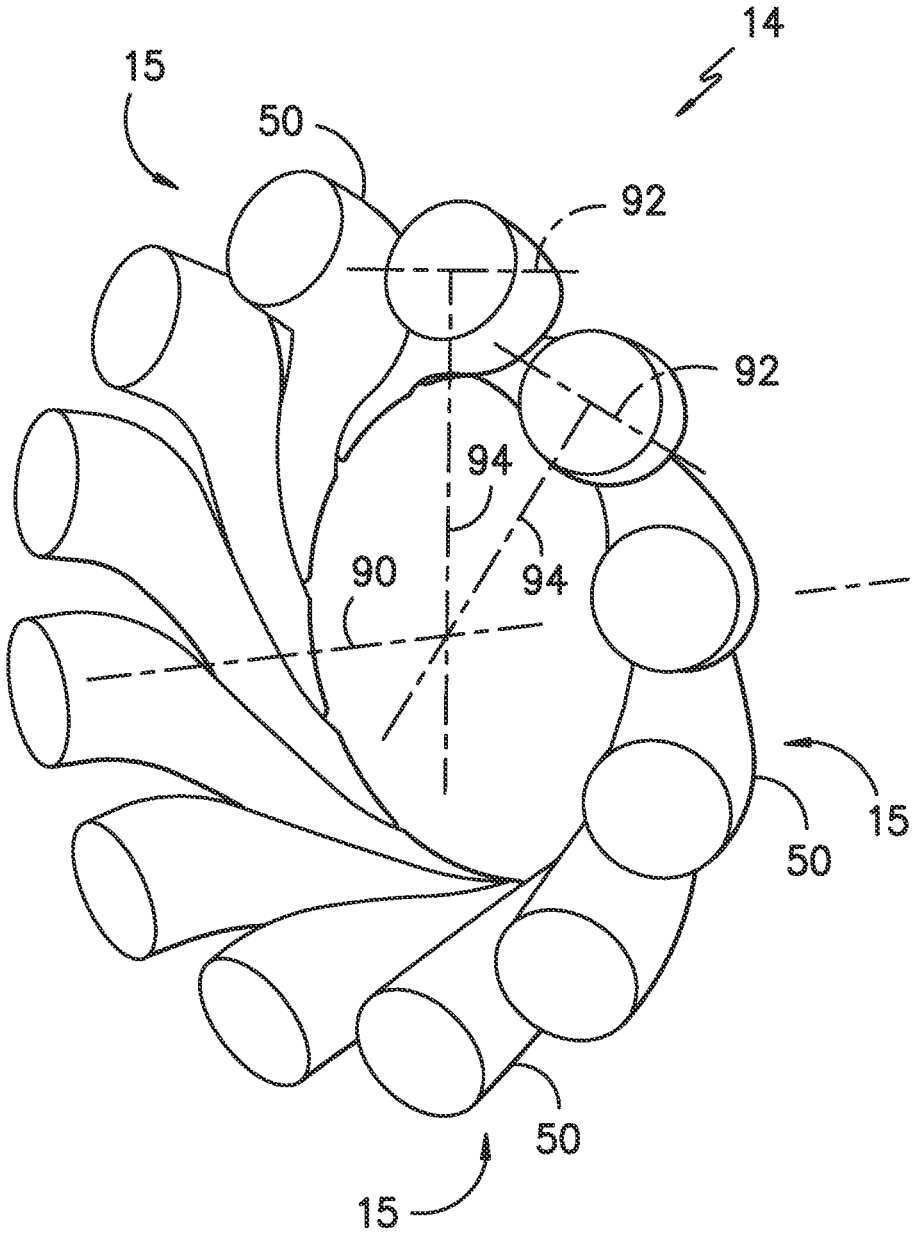
FIG. —3—

TRANSITION DUCT WITH DIVIDED UPSTREAM AND DOWNSTREAM PORTIONS

This invention was made with government support under contract number DE-FC26-05NT42643 awarded by the Department of Energy. The government has certain rights in the invention.

FIELD OF THE INVENTION

The subject matter disclosed herein relates generally to turbomachines, such as gas turbine systems, and more particularly to transition ducts having improved cooling features in turbomachines.

BACKGROUND OF THE INVENTION

Turbine systems are one example of turbomachines widely utilized in fields such as power generation. For example, a conventional gas turbine system includes a compressor section, a combustor section, and at least one turbine section. The compressor section is configured to compress air as the air flows through the compressor section. The air is then flowed from the compressor section to the combustor section, where it is mixed with fuel and combusted, generating a hot gas flow. The hot gas flow is provided to the turbine section, which utilizes the hot gas flow by extracting energy from it to drive the compressor, an electrical generator, and other various loads.

The combustor sections of turbine systems generally include tubes or ducts for flowing the combusted hot gas therethrough to the turbine section or sections. Recently, combustor sections have been introduced which include ducts that shift the flow of the hot gas, such as by accelerating and turning the hot gas flow. For example, ducts for combustor sections have been introduced that, while flowing the hot gas longitudinally therethrough, additionally shift the flow radially or tangentially such that the flow has various angular components. These designs have various advantages, including eliminating first stage nozzles from the turbine sections. The first stage nozzles were previously provided to shift the hot gas flow, and may not be required due to the design of these ducts. The elimination of first stage nozzles may reduce associated pressure drops and increase the efficiency and power output of the turbine system.

Various design and operating parameters influence the design and operation of combustor sections. For example, higher combustion gas temperatures generally improve the thermodynamic efficiency of the combustor section. However, such increased temperatures require improved cooling of the various turbine system components, in order to prevent or reduce the risk of damage to the components from exposure to high temperatures. However, various problems are associated with known cooling techniques for turbine systems. For example, leakage of cooling air reduces cooling efficiency, and further causes less air to be routed for combustion. Additionally, known designs for cooling various components make inefficient use of the cooling air, causing further inefficiencies. These design and operating parameters are of particular concern when utilizing ducts that shift the flow of the hot gas therein, as discussed above, because of the high temperatures and heat transfer coefficients that are generated in the ducts, and specifically in downstream portions of the ducts.

Accordingly, improved combustor sections for turbomachines, such as for turbine systems, would be desired in the art. In particular, combustor sections with improved cooling designs would be advantageous.

BRIEF DESCRIPTION OF THE INVENTION

Aspects and advantages of the invention will be set forth in part in the following description, or may be obvious from the description, or may be learned through practice of the invention.

In one embodiment, a turbine system is provided. The turbine system includes a transition duct comprising an inlet, an outlet, and a duct passage extending between the inlet and the outlet and defining a longitudinal axis, a radial axis, and a tangential axis. The outlet of the transition duct is offset from the inlet along the longitudinal axis and the tangential axis. The duct passage includes an upstream portion extending from the inlet and a downstream portion extending from the outlet. The turbine system further includes a rib extending from an outer surface of the duct passage, the rib dividing the upstream portion and the downstream portion.

In another embodiment, a turbine system is provided. The turbine system includes a transition duct comprising an inlet, an outlet, and a duct passage extending between the inlet and the outlet and defining a longitudinal axis, a radial axis, and a tangential axis. The outlet of the transition duct is offset from the inlet along the longitudinal axis and the tangential axis. The turbine system further includes a flow sleeve generally surrounding the transition duct, the flow sleeve comprising an upstream outlet, a downstream outlet, and a sleeve passage extending between the upstream outlet and the downstream outlet. The turbine system further includes a cavity defined between the transition duct and the flow sleeve, the cavity comprising an upstream cavity and a downstream cavity, and a rib positioned between the transition duct and the flow sleeve, the rib dividing the upstream cavity and the downstream cavity.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which:

FIG. 1 is a schematic view of a gas turbine system according to one embodiment of the present disclosure;

FIG. 2 is a cross-sectional view of several portions of a gas turbine system according to one embodiment of the present disclosure;

FIG. 3 is a perspective view of an annular array of transition ducts and associated impingement sleeves according to one embodiment of the present disclosure;

DETAILED DESCRIPTION OF THE INVENTION

Figure 4:
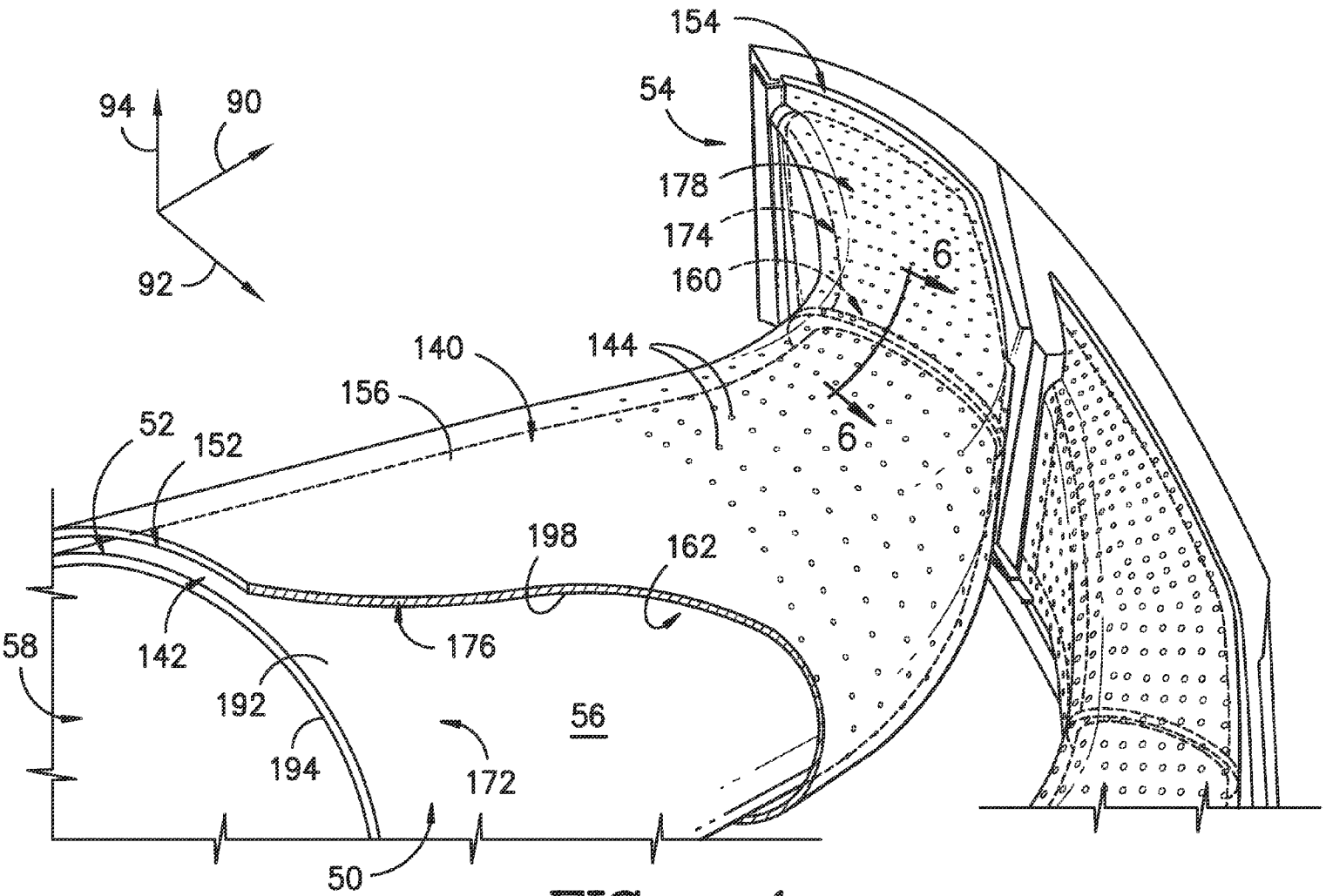
FIG. 4 is a top rear perspective view of a plurality of transition ducts and associated impingement sleeves according to one embodiment of the present disclosure.
Figure 5:
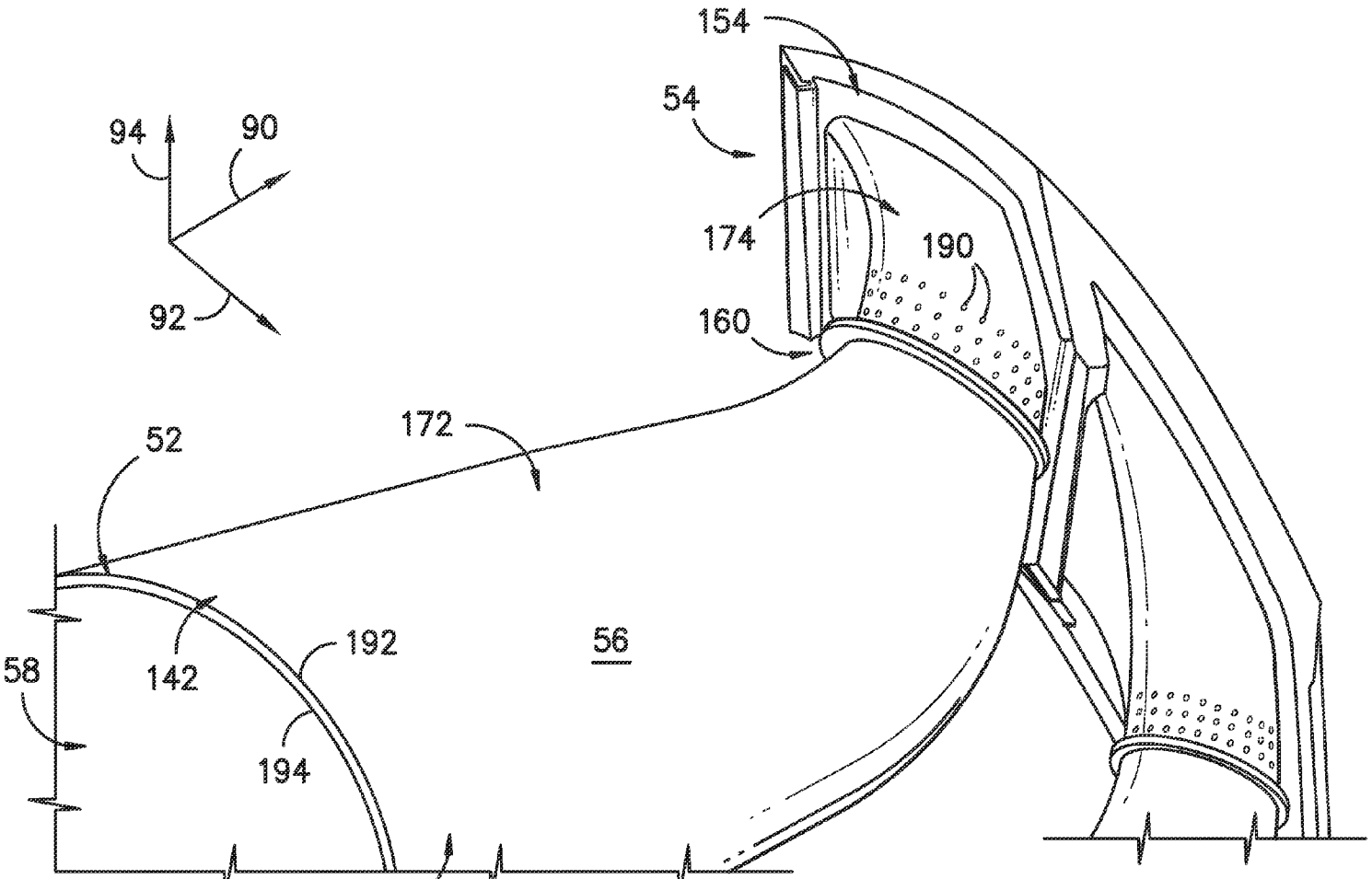
FIG. 5 is a top rear perspective view of a plurality of transition ducts, with associated impingement sleeves removed, according to another embodiment of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 is a schematic diagram of a turbomachine, which in the embodiment shown is a gas turbine system 10. It should be understood that the turbine system 10 of the present disclosure need not be a gas turbine system 10, but rather may be any suitable turbine system 10, such as a steam turbine system or other suitable system. Further, it should be understood that a turbomachine according to the present disclosure need not be a turbine system, but rather may be any suitable turbomachine. The gas turbine system 10 may include a compressor section 12, a combustor section 14 which may include a plurality of combustors 15 as discussed below, and a turbine section 16. The compressor section 12 and turbine section 16 may be coupled by a shaft 18. The shaft 18 may be a single shaft or a plurality of shaft segments coupled together to form shaft 18. The shaft 18 may further be coupled to a generator or other suitable energy storage device, or may be connected directly to, for example, an electrical grid. An inlet section 19 may provide an air flow to the compressor section 12, and exhaust gases may be exhausted from the turbine section 16 through an exhaust section 20 and exhausted and/or utilized in the system 10 or other suitable system, exhausted into the atmosphere, or recycled through a heat recovery steam generator.

Referring to FIG. 2, a simplified drawing of several portions of a gas turbine system 10 is illustrated. The gas turbine system 10 as shown in FIG. 2 comprises a compressor section 12 for pressurizing a working fluid, which in general is pressurized air but could be any suitable fluid, that is flowing through the system 10. Pressurized working fluid discharged from the compressor section 12 flows into a combustor section 14, which may include a plurality of combustors 15 (only one of which is illustrated in FIG. 2) disposed in an annular array about an axis of the system 10. The working fluid entering the combustor section 14 is mixed with fuel, such as natural gas or another suitable liquid or gas, and combusted. Hot gases of combustion flow from each combustor 15 to a turbine section 16 to drive the system 10 and generate power.

A combustor 15 in the gas turbine 10 may include a variety of components for mixing and combusting the working fluid and fuel. For example, the combustor 15 may include a casing 21, such as a compressor discharge casing 21. A variety of sleeves, which may be axially extending annular sleeves, may be at least partially disposed in the casing 21. The sleeves, as shown in FIG. 2, extend axially along a generally longitudinal axis 98, such that the inlet of a sleeve is axially aligned with the outlet. For example, a combustor liner 22 may generally define a combustion zone 24 therein. Combustion of the working fluid, fuel, and optional oxidizer may generally occur in the combustion zone 24. The resulting hot gases of combustion may flow generally axially along the longitudinal axis 98 downstream through the combustion liner 22 into a transition piece 26, and then flow generally axially along the longitudinal axis 98 through the transition piece 26 and into the turbine section 16.

The combustor 15 may further include a fuel nozzle 40 or a plurality of fuel nozzles 40. Fuel may be supplied to the fuel nozzles 40 by one or more manifolds (not shown). As discussed below, the fuel nozzle 40 or fuel nozzles 40 may supply the fuel and, optionally, working fluid to the combustion zone 24 for combustion.

As shown in FIGS. 3 through 6, a combustor 15 according to the present disclosure may include one or more transition ducts 50. The transition ducts 50 of the present disclosure may be provided in place of various axially extending sleeves of other combustors. For example, a transition duct 50 may replace the axially extending transition piece 26 and, optionally, the combustor liner 22 of a combustor 15. Thus, the transition duct may extend from the fuel nozzles 40, or from the combustor liner 22. As discussed below, the transition duct 50 may provide various advantages over the axially extending combustor liners 22 and transition pieces 26 for flowing working fluid therethrough and to the turbine section 16.

As shown, the plurality of transition ducts 50 may be disposed in an annular array about a longitudinal axis 90. Further, each transition duct 50 may extend between a fuel nozzle 40 or plurality of fuel nozzles 40 and the turbine section 16. For example, each transition duct 50 may extend from the fuel nozzles 40 to the turbine section 16. Thus, working fluid may flow generally from the fuel nozzles 40 through the transition duct 50 to the turbine section 16. In some embodiments, the transition ducts 50 may advantageously allow for the elimination of the first stage nozzles in the turbine section, which may reduce or eliminate any associated pressure loss and increase the efficiency and output of the system 10.

Each transition duct 50 may have an inlet 52, an outlet 54, and a passage 56 therebetween. The passage 56 defines a combustion chamber 58 therein, through which the hot gases of combustion flow. The inlet 52 and outlet 54 of a transition duct 50 may have generally circular or oval cross-sections, rectangular cross-sections, triangular cross-sections, or any other suitable polygonal cross-sections. Further, it should be understood that the inlet 52 and outlet 54 of a transition duct 50 need not have similarly shaped cross-sections. For example, in one embodiment, the inlet 52 may have a generally circular cross-section, while the outlet 54 may have a generally rectangular cross-section.

Further, the passage 56 may be generally tapered between the inlet 52 and the outlet 54. For example, in an exemplary embodiment, at least a portion of the passage 56 may be generally conically shaped. Additionally or alternatively, however, the passage 56 or any portion thereof may have a generally rectangular cross-section, triangular cross-section, or any other suitable polygonal cross-section. It should be understood that the cross-sectional shape of the passage 56 may change throughout the passage 56 or any portion thereof as the passage 56 tapers from the relatively larger inlet 52 to the relatively smaller outlet 54.

The outlet 54 of each of the plurality of transition ducts 50 may be offset from the inlet 52 of the respective transition duct 50. The term "offset", as used herein, means spaced from along the identified coordinate direction. The outlet 54 of each of the plurality of transition ducts 50 may be longitudinally offset from the inlet 52 of the respective transition duct 50, such as offset along the longitudinal axis 90.

Additionally, in exemplary embodiments, the outlet 54 of each of the plurality of transition ducts 50 may be tangentially offset from the inlet 52 of the respective transition duct 50, such as offset along a tangential axis 92. Because the outlet 54 of each of the plurality of transition ducts 50 is tangentially offset from the inlet 52 of the respective transition duct 50, the transition ducts 50 may advantageously utilize the tangential component of the flow of working fluid through the transition ducts 50 to eliminate the need for first stage nozzles in the turbine section 16, as discussed below.

Further, in exemplary embodiments, the outlet 54 of each of the plurality of transition ducts 50 may be radially offset from the inlet 52 of the respective transition duct 50, such as offset along a radial axis 94. Because the outlet 54 of each of the plurality of transition ducts 50 is radially offset from the inlet 52 of the respective transition duct 50, the transition ducts 50 may advantageously utilize the radial component of the flow of working fluid through the transition ducts 50 to further eliminate the need for first stage nozzles in the turbine section 16, as discussed below.

It should be understood that the tangential axis 92 and the radial axis 94 are defined individually for each transition duct 50 with respect to the circumference defined by the annular array of transition ducts 50, as shown in FIG. 3, and that the axes 92 and 94 vary for each transition duct 50 about the circumference based on the number of transition ducts 50 disposed in an annular array about the longitudinal axis 90.

Figure 8:
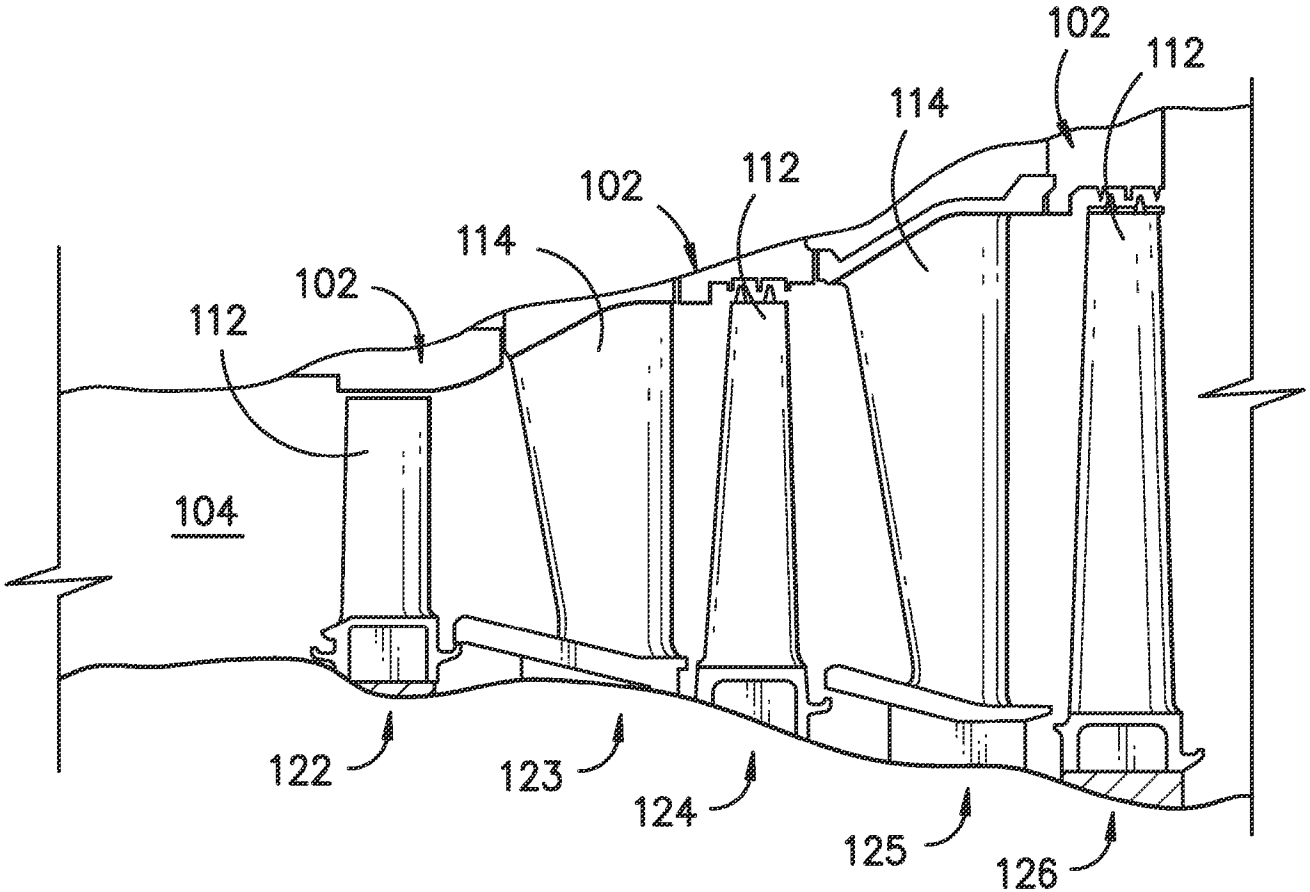
FIG. 8 is a cross-sectional view of a turbine section of a gas turbine system according to one embodiment of the present disclosure.

As discussed, after hot gases of combustion are flowed through the transition duct 50, they may be flowed from the transition duct 50 into the turbine section 16. As shown in FIG. 8, a turbine section 16 according to the present disclosure may include a shroud 102, which may define a hot gas path 104. The shroud 102 may be formed from a plurality of shroud blocks 106. The shroud blocks 106 may be disposed in one or more annular arrays, each of which may define a portion of the hot gas path 104 therein.

The turbine section 16 may further include a plurality of buckets 112 and a plurality of nozzles 114. Each of the plurality of buckets 112 and nozzles 114 may be at least partially disposed in the hot gas path 104. Further, the plurality of buckets 112 and the plurality of nozzles 114 may be disposed in one or more annular arrays, each of which may define a portion of the hot gas path 104.

The turbine section 16 may include a plurality of turbine stages. Each stage may include a plurality of buckets 112 disposed in an annular array and a plurality of nozzles 114 disposed in an annular array. For example, in one embodiment, the turbine section 16 may have three stages, as shown in FIG. 8. For example, a first stage of the turbine section 16 may include a first stage nozzle assembly (not shown) and a first stage buckets assembly 122. The nozzles assembly may include a plurality of nozzles 114 disposed and fixed circumferentially about the shaft 18. The bucket assembly 122 may include a plurality of buckets 112 disposed circumferentially about the shaft 18 and coupled to the shaft 18. In exemplary embodiments wherein the turbine section is coupled to combustor section 14 comprising a plurality of transition ducts 50, however, the first stage nozzle assembly may be eliminated, such that no nozzles are disposed upstream of the first stage bucket assembly 122. Upstream may be defined relative to the flow of hot gases of combustion through the hot gas path 104.

A second stage of the turbine section 16 may include a second stage nozzle assembly 123 and a second stage buckets assembly 124. The nozzles 114 included in the nozzle assembly 123 may be disposed and fixed circumferentially about the shaft 18. The buckets 112 included in the bucket assembly 124 may be disposed circumferentially about the shaft 18 and coupled to the shaft 18. The second stage nozzle assembly 123 is thus positioned between the first stage bucket assembly 122 and second stage bucket assembly 124 along the hot gas path 104. A third stage of the turbine section 16 may include a third stage nozzle assembly 125 and a third stage bucket assembly 126. The nozzles 114 included in the nozzle assembly 125 may be disposed and fixed circumferentially about the shaft 18. The buckets 112 included in the bucket assembly 126 may be disposed circumferentially about the shaft 18 and coupled to the shaft 18. The third stage nozzle assembly 125 is thus positioned between the second stage bucket assembly 124 and third stage bucket assembly 126 along the hot gas path 104.

It should be understood that the turbine section 16 is not limited to three stages, but rather that any number of stages are within the scope and spirit of the present disclosure.

Figure 6:
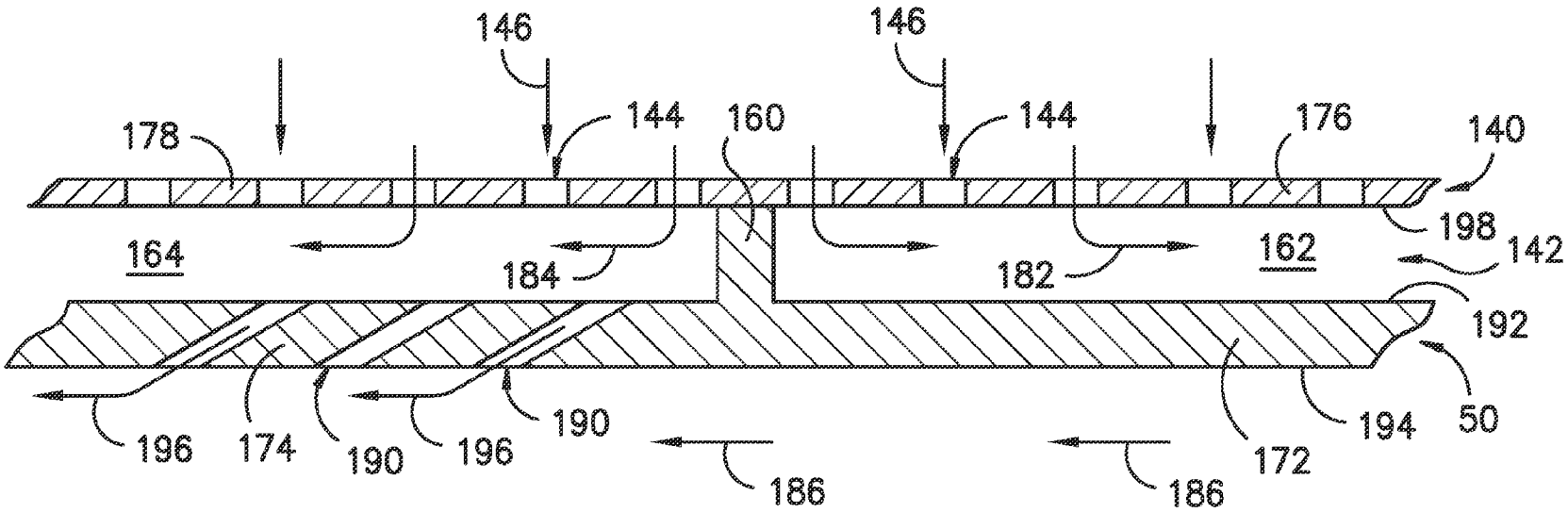
FIG. 6 is a cross-sectional view of portions of a transition duct and associated impingement sleeve according to one embodiment of the present disclosure.
Figure 7:
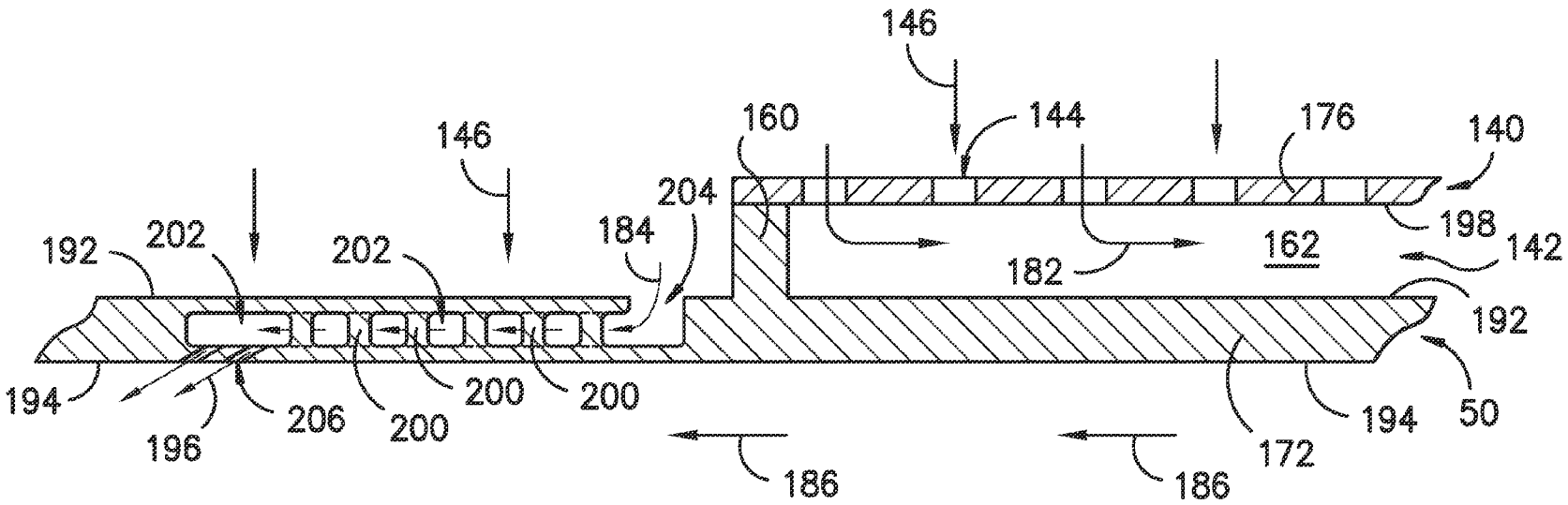
FIG. 7 is a cross-sectional view of portions of a transition duct and associated impingement sleeve according to another embodiment of the present disclosure.

As shown in FIGS. 4, 6 and 7, in exemplary embodiments, a flow sleeve 140 may generally surround, such as in a generally circumferential fashion, a transition duct 50. A flow sleeve 140 circumferentially surrounding a transition duct 50 may define a cavity 142 therebetween. Compressed working fluid 146 from the casing 21 may flow through the cavity 142 to provide convective cooling to the transition duct 50. Further, in some embodiments, the flow sleeve 140 may be an impingement sleeve. In these embodiments, impingement holes 144 may be defined in the sleeve 140, as shown. Compressed working fluid 146 from the casing 21 may flow through the impingement holes 144 and impinge on the transition duct 50 before flowing through the cavity 142, thus providing additional impingement cooling of the transition duct.

Each flow sleeve 140 may have an upstream outlet 152, a downstream outlet 154, and a passage 156 therebetween. Each flow sleeve 140 may extend between a fuel nozzle 40 or plurality of fuel nozzles 40 and the turbine section 16, thus surrounding at least a portion of the associated transition duct 50. Thus, similar to the transition ducts 50, as discussed above, the downstream outlet 154 of each of the plurality of flow sleeves 140 may be longitudinally, radially, and/or tangentially offset from the upstream outlet 152 of the respective flow sleeve 140.

As discussed, working fluid 146 may flow through the cavity 142 defined between the transition duct 50 and the flow sleeve 140. This working fluid 146 may cool the transition duct 50 during operation of the turbomachine. As discussed above, it is desirable that the working fluid 146 is efficiently utilized to cool the transition duct 50. Thus, in exemplary embodiments, a rib 160 may be included in the cavity 142 of one or more transition ducts 50 and associated flow sleeves 140. The rib 160 may be positioned between the transition duct 50 and flow sleeve 140, and may divide the cavity 142 into an upstream cavity 162 and a downstream cavity 164. Thus, the transition duct 50, such as the passage 56 thereof, may be divided by the rib 160 into an upstream portion 172 and a downstream portion 174, and the flow sleeve 140 may similarly be divided by the rib 160 into an upstream portion 176 and a downstream portion 178.

By dividing the cavity 162 and associated transition duct 50 and flow sleeve 142, the rib 160 may allow a portion 182 of the working fluid 146 in the upstream cavity 162 to provide advantageous flow and cooling characteristics required for that cavity, while allowing a portion 184 of the working fluid 146 in the downstream cavity 164 to provide separate advantageous flow and cooling characteristics required for that cavity. For example, as shown in FIGS. 6 and 7, the portion 184 in the downstream cavity 164 may flow generally downstream, advantageously cooling the downstream portion 174 of the passage 56. Notably, the flow 186 of hot gas of combustion through the downstream portion 174, due to the design of the transition duct 50 and passage 56 thereof, may have relatively higher Mach numbers, and heat transfer coefficients in the downstream portion 172 may be relatively greater. The use of ribs 160 according to the present disclosure may advantageously provide targeted cooling of the downstream portion 174. Further, in exemplary embodiments, the downstream portion 174 of the passage 56 may include a plurality of film cooling passages 190 defined therein, extending between an outer surface 192 and an inner surface 194 of the passage 56. Each film cooling passage 190 may communicate a film cooling portion 196 of the downstream portion 184 of working fluid 146 to the combustion chamber 58 of the transition duct 50. This film cooling portion 196 may flow generally downstream along the inner surface 194 of the passage 56, providing further cooling to the downstream portion 174.

As further shown in FIGS. 6 and 7, the portion 182 in the upstream cavity 162 may flow generally upstream, advantageously cooling the upstream portion 172 of the passage 56. Such flow may cool the upstream portion 172, while additionally supplying this portion 182 to the fuel nozzles 40 for mixing with fuel and combustion thereof. The use of ribs 160 according to the present disclosure may thus advantageously provide targeted cooling of the upstream portion 172, while efficiently providing a portion 182 of the working fluid 146 for combustion.

In exemplary embodiments, the rib 160 may generally isolate the upstream cavity 162 and downstream cavity 164 (and various portions thereof) from each other. In these embodiments, the rib 160 effectively seals the upstream cavity 162 and downstream cavity 164 from each other, such that no or minimal of the portion 182 of working fluid 146 can flow past the rib 160 from the upstream cavity 162 into the downstream cavity 164, and no or minimal of the portion 184 of working fluid 146 can flow past the rib 160 from the downstream cavity 164 into the upstream cavity 162. By isolating the cavities, 162, 164, the efficiency of cooling and use of the working fluid 146 is increased.

A rib 160 according to the present disclosure extends generally peripherally about the periphery of a transition duct 50, thus dividing the transition duct 50 into the upstream portion 172 and downstream portion 174 and dividing the flow sleeve 140 into the upstream portion 176 and downstream portion 178. The rib 160 may be a singular component or a plurality of components positioned between the transition duct 50 and flow sleeve 140 to provide such division. In exemplary embodiments, a rib 160 extends from the outer surface 192 of the passage 56. The rib 160 may be integral with the passage 56, as shown in FIG. 6. For example, the rib 160 and passage 56 may be cast as a singular component. Alternatively, the rib 160 may be mounted to the passage 56, such as through welding, brazing, bolting, etc. Additionally or alternatively, the rib 160 may extend from an inner surface 198 of the flow sleeve 140, and may be integral with or mounted to the flow sleeve 140.

Use of a rib 160 according to the present disclosure may thus provide improved cooling to transition ducts 50 and turbomachines utilizing the transition ducts 50. Such cooling may be particularly targeted as described above to efficiently cool the transition ducts 50 while reducing leakage and providing sufficient working fluid 146 for combustion.

As further shown in FIG. 7, a transition duct 50 according to the present disclosure may include a plurality of internal pins 200 that further facilitate cooling thereof. In these embodiments, the passage 56 or a portion thereof may be generally hollow, defining an interior 202 between the outer surface 192 and inner surface 194. Pins 200 may be disposed in the interior 202, in some embodiments in one or more generally circumferential rows, extending generally between the outer surface 192 and inner surface 194. Access holes 204 may be defined in the outer surface 192, such that working fluid 146 or a portion thereof, such as portion 184, flows through the access holes 204 into the interior 202. In exemplary embodiments, the access holes 204 may be located upstream of the pins 200. This working fluid 146 or portion thereof may then flow past the pins 200, cooling the pins 200 and transition duct 50 in general. Film cooling passages 206 or other suitable exhaust holes may be defined in the inner surface 194, such that the working fluid 146 or portion thereof may then be exhausted from the interior 202 to the combustion chamber 58 of the transition duct 50, to flow generally downstream, such as along the inner surface 194 of the passage 56 within the combustion chamber 58, providing further cooling to the passage 56. In exemplary embodiments, film cooling passages 206 or other suitable exhaust holes may be disposed downstream of the pins 200.

In exemplary embodiments as shown, pins 200 may be provided only in the downstream portion 174 of the transition duct 50. Additionally or alternatively, however, pins 200 may be included in the upstream portion 172. Further, it should be understood that the use of pins 200 according to the present disclosure is not limited to embodiments wherein the transition duct 50 utilizes a rib 160, but rather may be utilized in any suitable transition duct 50.

Additionally, in some embodiments wherein pins 200 are utilized, various portions of the flow sleeve 140 may not be required. For example, as shown in FIG. 7, the flow sleeve 140 may only include the upstream portion 176, and not the downstream portion 178, due to the use of pins 200 in the downstream portion 174 of the transition duct 50. Alternatively, however, the downstream portion 174 may be included. Further, any suitable portion of the flow sleeve 140 may or may not be included when pins 200 are utilized.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A turbine system, comprising:

a transition duct comprising an inlet, an outlet, and a duct passage extending between the inlet and the outlet and defining a longitudinal axis, a radial axis, and a tangential axis, the outlet of the transition duct offset from the inlet along the longitudinal axis and the tangential axis, the duct passage comprising an upstream portion extending from the inlet and a downstream portion extending from the outlet; and a rib extending from an outer surface of the duct passage and around an entire periphery of the outer surface, the rib dividing the upstream portion and the downstream portion and partially defining and fluidly dividing an upstream cavity and a downstream cavity, the upstream cavity configured to direct a first portion of a working fluid towards the inlet, the downstream cavity configured to direct a second portion of the working fluid towards the outlet.

2. The turbine system of claim 1, further comprising a flow sleeve generally surrounding the transition duct, the flow sleeve comprising an upstream outlet, a downstream outlet, and a sleeve passage extending between the upstream outlet and the downstream outlet, the sleeve passage comprising an upstream portion extending from the upstream outlet and a downstream portion extending from the downstream outlet, and wherein the rib further divides the upstream portion of the flow sleeve and the downstream portion of the flow sleeve.

3. The turbine system of claim 2, wherein the upstream portions of the transition duct and the flow sleeve define the upstream cavity therebetween, wherein the downstream portions of the transition duct and the flow sleeve define the downstream cavity therebetween, and wherein the rib generally fluidly isolates the upstream cavity and the downstream cavity from each other.

4. The turbine system of claim 2, wherein the flow sleeve is an impingement sleeve.

5. The turbine system of claim 1, wherein the rib is integral with the passage.

6. The turbine system of claim 1, wherein a plurality of film cooling holes are defined in the downstream portion of the duct passage.

7. The turbine system of claim 1, wherein the outlet of the transition duct is further offset from the inlet along the radial axis.

8. The turbine system of claim 1, wherein the downstream portion further comprises a plurality of internal pins.

9. The turbine system of claim 1, further comprising a turbine section in communication with the transition duct, the turbine section comprising a first stage bucket assembly.

10. The turbine system of claim 9, wherein no nozzles are disposed upstream of the first stage bucket assembly.

11. A turbine system, comprising:

a transition duct comprising an inlet, an outlet, and a duct passage extending between the inlet and the outlet and defining a longitudinal axis, a radial axis, and a tangential axis, the outlet of the transition duct offset from the inlet along the longitudinal axis and the tangential axis;

a flow sleeve generally surrounding the transition duct, the flow sleeve comprising an upstream outlet, a downstream outlet, and a sleeve passage extending between the upstream outlet and the downstream outlet;

a cavity defined between the transition duct and the flow sleeve, the cavity comprising an upstream cavity and a downstream cavity; and a rib positioned between the transition duct and the flow sleeve, the rib extending around an entire periphery of the duct passage and fluidly dividing the upstream cavity and the downstream cavity, wherein the upstream cavity is configured to direct a first portion of a working fluid towards the upstream outlet, and wherein the downstream cavity is configured to direct a second portion of the working fluid towards the downstream outlet.

12. The turbine system of claim 11, wherein the rib generally fluidly isolates the upstream cavity and the downstream cavity from each other.

13. The turbine system of claim 11, wherein the rib extends from an outer surface of the duct passage.

14. The turbine system of claim 11, wherein the flow sleeve is an impingement sleeve.

15. The turbine system of claim 11, wherein a plurality of film cooling holes are defined in the downstream portion of the duct passage.

16. The turbine system of claim 11, wherein the outlet of the transition duct is further offset from the inlet along the radial axis.

17. The turbine system of claim 11, further comprising a turbine section in communication with the transition duct, the turbine section comprising a first stage bucket assembly.

18. The turbine system of claim 17, wherein no nozzles are disposed upstream of the first stage bucket assembly.

19. A turbomachine, comprising:

an inlet section;

an exhaust section;

a compressor section;

a combustor section, the combustor section comprising:

a transition duct comprising an inlet, an outlet, and a duct passage extending between the inlet and the outlet and defining a longitudinal axis, a radial axis, and a tangential axis, the outlet of the transition duct offset from the inlet along the longitudinal axis and the tangential axis;

a flow sleeve generally surrounding the transition duct, the flow sleeve comprising an upstream outlet, a downstream outlet, and a sleeve passage extending between the upstream outlet and the downstream outlet;

a cavity defined between the transition duct and the flow sleeve, the cavity comprising an upstream cavity and a downstream cavity; and a rib positioned between the transition duct and the flow sleeve, the rib extending around an entire periphery of the duct passage and fluidly dividing the upstream cavity and the downstream cavity, wherein the upstream cavity is configured to direct a first portion of a working fluid towards the upstream outlet, and wherein the downstream cavity is configured to direct a second portion of the working fluid towards the downstream outlet; and a turbine section in communication with the transition duct, the turbine section comprising a first stage bucket assembly, wherein no nozzles are disposed upstream of the first stage bucket assembly.

20. The turbomachine of claim 19, wherein the rib generally fluidly isolates the upstream cavity and the downstream cavity from each other.

* * * * *